US007988237B2

(12) United States Patent
Peters

(10) Patent No.: US 7,988,237 B2
(45) Date of Patent: Aug. 2, 2011

(54) CHAIR PROVIDING BALLISTIC DEFENSE SHIELD

(75) Inventor: Fred E. Peters, Orange, CA (US)

(73) Assignee: Peters Security International, Inc., Orange, CA (US)

( * ) Notice: Subject to any disclaimer, the term of this patent is extended or adjusted under 35 U.S.C. 154(b) by 0 days.

(21) Appl. No.: 12/791,814

(22) Filed: Jun. 1, 2010

(65) Prior Publication Data

US 2010/0327639 A1 Dec. 30, 2010

Related U.S. Application Data

(60) Provisional application No. 61/217,526, filed on Jun. 1, 2009.

(51) Int. Cl.
*A47B 97/00* (2006.01)

(52) U.S. Cl. ..... 297/463.2; 297/440.22; 297/463.1; 297/DIG. 6; 297/183.6

(58) Field of Classification Search ..... 297/463.1, 297/463.2, 440.2, 440.21, 440.22, 183.6, 297/DIG. 6

See application file for complete search history.

(56) References Cited

U.S. PATENT DOCUMENTS

| | | | | |
|---|---|---|---|---|
| 3,146,028 | A * | 8/1964 | Grosfillex | 297/440.22 |
| 3,825,302 | A * | 7/1974 | Kurtz | 297/440.22 |
| 4,442,780 | A * | 4/1984 | Child | 109/29 |
| 5,515,549 | A * | 5/1996 | Wang | 297/183.6 |
| 6,691,601 | B2 * | 2/2004 | Cohen et al. | 109/49.5 |
| 2003/0198766 | A1 * | 10/2003 | Ezoe | 428/36.1 |
| 2005/0053769 | A1 * | 3/2005 | Imblum et al. | 428/170 |

* cited by examiner

*Primary Examiner* — Anthony D Barfield
(74) *Attorney, Agent, or Firm* — Richard D. Clarke

(57) ABSTRACT

A protective chair having a base with a support platform having supporting legs extending therefrom to hold the platform and an engaged seat cushion elevated from a support surface. A seatback, and seat cushion and secondary cushions extending away from the seat cushion are engaged to the base. Each of the seatback, seat cushion and extending cushions have one or a plurality of bullet resistant layers which provide a ballistic shield for a user who picks up the chair and holds it in an as-used position, in-between the user and an assailant. A viewing slit positioned between the extending cushions and the seat cushion allows the user to view a potential assailant on the other side. Elongated members extending away from the seat cushion, on the side of the chair opposite the user, may be employed to attack the assailant.

20 Claims, 3 Drawing Sheets

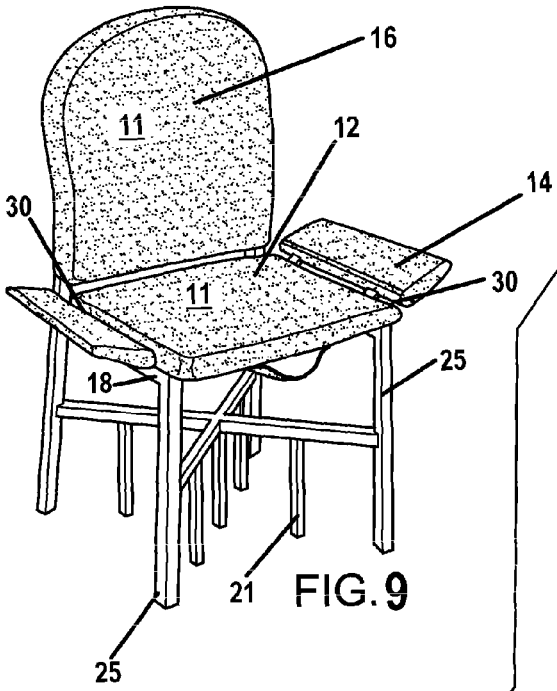
FIG. 9
FIG. 10
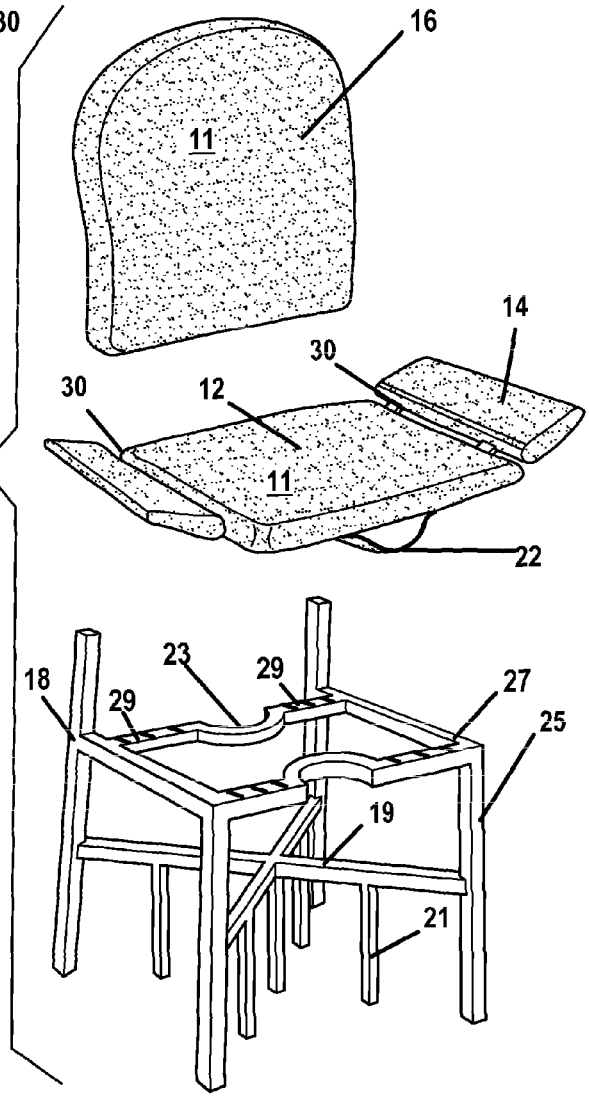

CHAIR PROVIDING BALLISTIC DEFENSE SHIELD

FIELD OF THE INVENTION

This application claims the benefit of U.S. Provisional Application No. 61/217,526 which was filed Jun. 1, 2009 and which is incorporated herein in its entirety by reference.

The disclosed device relates to a body protective device configured in the form of a chair which is conventionally employed in schools, offices, conference halls, cafeterias, libraries, military bases, government buildings, airports and other venues where users sit. More particularly it relates to a chair which may be picked up by the user and has cushions adapted to provide a shield to the user from ballistic projectiles such as bullets. Concurrently, the chair provides offensive capability to the occupant should they desire to attack the source of the threat.

BACKGROUND OF THE INVENTION

In the modern world, crimes and attacks committed by persons with guns are an ever more common occurrence. In decades past, police personnel and military personnel have been the primary targets of gunfire which has been directed toward them during work or duty. Because of this continual risk of harm, bullet resistant vests and shields have been developed which may be deployed or worn on the user's body as a protective component of their work attire. Such devices, when employed for protection against weapons fire have worked fairly well in preventing a high velocity bullet or shell from penetrating the wearer's body even if the bullet contacts it since the velocity is slowed considerably.

In recent years however, especially subsequent to attacks such as that on Columbine High School in Colorado in 1999 and on New York on Sep. 11, 2001, the threat of violence and injury due to gunshots has expanded to everyday citizens and students. Consequently, the risk to human life and health has occurred in venues where such a risk of death or injury from bullet wounds was never perceived to be a risk. In recent years, students attending colleges, high schools, and junior high and even lower grades have suddenly come under fire from attackers carrying and discharging firearms on school grounds. Even the military is not immune to unexpected attacks by gunfire as can be seen by the deadly incident in 2009 in a meeting hall of a large Texas military base.

While bullet-resistant vests and other attire worn by the military and police officers may provide reasonable protection of the upper body for such users, this type of device is not practical for students or workers or ordinary people as daily wear in a conventional domestic gathering such as a meeting room, classroom, cafeteria, office, or convention center and the like.

As a consequence of the last decade's escalation worldwide in terrorism and violence encountered by military personnel, police officers, students, workers, and other individuals, some form of protection should be made available to such chair-users which is readily available should the need arise. However, such a device should also blend into a conventional room appearance where people gather such as a meeting room, classroom, library or cafeteria and it should thereby refrain from making a room where people gather for social or educational purposes appear like a military bunker.

Further, such a protective device should not just be discreetly available to military personnel, police, governments, students, and workers, but should also be deployable to homes and other venues where occupants might feel the need to afford themselves protection against the risk of gunshot injury.

Further, from the experience of recent attacks on students in schools, it has been shown that students, and others, untrained in what action to take when faced with such an unexpected lethal threat from armed assailants, act in differing ways. Most freeze for a few moments trying to comprehend the incomprehensible. This just enhances their target status to the perpetrator. Some freeze completely and remain in place or fall to the ground in a fetal panic position becoming stationary targets. Others may rush away from the source, frequently to the far corners of the room, where no exit exists or to the only narrow exit, blocking it and preventing escape. Panic in such emergency situations in large facilities, such as has happened in cafeterias and convention centers, results in trampling others in their escape attempts. As can be seen, all of these untrained responses are counter productive to the threat of a gunman intent on harming people. Instead of providing protection or safety, the reactions provide grouped and easy targets for a gunman.

As such, there exists an unmet need for a device which blends into the room surroundings where occupants gather for group activity such as a meeting room, classroom, library or cafeteria. Such a device should be easily employed and close at hand for the occupants of the room to pick up and employ the device against an assailant during an attack. Such a device should appear as ordinary furniture in the room so as to maintain the ambience of a group setting. Finally, such a device when picked up and held by the user as a shield should concurrently provide the user a means to attack their assailant should they so choose, rather than to simply cower behind a shield and wait for the attacker to circumvent their protection.

With respect to the above, before explaining at least one preferred embodiment of the ballistic protection device herein in detail or in general, it is to be understood that the invention is not limited in its application to the details of construction and to the arrangement of the components or the steps set forth in the following description or illustrated in the drawings. The various apparatus and methods of the protective invention herein are capable of other embodiments and of being practiced and carried out in various ways, all of which will be obvious to those skilled in the art once the information herein is reviewed. Also, it is to be understood that the phraseology and terminology employed herein are for the purpose of description, and should not be regarded as limiting in any fashion.

As such, those skilled in the art will appreciate that the conception upon which this disclosure is based may readily be utilized as a basis for designing other furniture type ballistic shields for carrying out the several purposes of the present disclosed device and method. It is important, therefore, that the embodiments, objects and claims herein, be regarded as including such equivalent construction and methodology insofar as they do not depart from the spirit and scope of the present invention.

SUMMARY OF THE INVENTION

The device disclosed in the specification and drawings herein provides a remedy to the aforementioned shortcomings of conventional art. In one preferred mode the device having the appearance and ambiance of a chair, wherein a cushion and a back cushion are supported by a frame elevated above a support surface. Both the cushion portion and the seat back cushion are of layered construction having at least one internal layer formed of one or a combination of bullet resistant materials including a plate formed of titanium, ceramic, or polyethylene material or a textile matrix formed of bullet resistant fabric such as aramid. There may also be a plurality of layers forming the one layer or a plurality of adjacent layers formed within the cushion and back cushion of the device. This internal layer or layers, and the handle shields, as noted, may be formed of one or a combination of the above noted bullet resistant materials or it may include other bullet resistant materials as would occur to those skilled in the art. With modern synthetic textiles, metal alloys and other ballistic protecting materials ever-evolving, it is anticipated that one skilled in the art, upon being educated by this disclosure, may employ a different or new ballistic material. Any and all such ballistic resistant materials, alone or in combination, as would occur to those skilled in the art, are anticipated to be within the scope of this patent.

Manufactured in a fashion shown in the drawings and described herein, the device has an outer material surface which would be that of a conventional chair seat such as an upholstery material, or plastic or other water resistant materials should an outdoor venue be anticipated. The internal shielding layer or layers would provide the user protection from bullet and high velocity projectiles thereby maintaining the appearance of the room in which the chair device sits as that of a room to gather rather than appearing as a bunker.

The cushion portion has a pair of projecting wings or extending cushions which are engaged to the seat cushion and provide additional protection for the user by increasing the area of coverage of the internal protective layer past the edges of the seat cushion. The extending cushions might also be engaged to members extending from the base or from the back cushion but currently attachment to side surfaces of the seat cushion is the favored mode. A small gap is preferably provided between the projecting wings and the cushion thereby providing the user a viewing slot when holding the chair in the as-used position of FIG. 8 as a means for viewing the assailant and the side of the room opposite the top surface of the seat cushion. The projecting extending cushions may be rotationally engaged to the sides of the cushion to allow them to rotate to a vertical disposition and function as an elevated armrest. This rotation will also provide means to adjust the width of the gap.

The seat back of this mode of the device is engaged to the base by sliding upon a pair of projecting rear members but can be engaged in other fashions familiar to those skilled in the art. The cushion portion is adapted with a pair of opposing handles formed into a bottom surface to allow a user to grip the cushion portion by engaging their hands into the formed handles. Handle shields are positioned to cover the handles to protect the user's hands from injury. The seat cushion and engaged wings may be permanently engaged to the base or may be removably engaged using material such as hook and loop fabric to allow only the cushion portion to be removed and held elevated if so desired by the user.

In use in an as-used position as in FIG. 8, the user will engage their hands behind both shields and within both handles to allow the device to be elevated with the slots running parallel to the floor supporting the user. This allows the user to peek through the slots at a potential attacker.

Another preferred mode of the device features a base having means to offensively attack an attacker. In this mode of the device, one or a plurality of projecting members extend from and attachment end to "bookrack" portion of the base in the same direction as its legs, to distal ends. A user may pick up and hold the device with the base, in the as-used position of FIG. 8, and may employ the projecting members to attack an assailant by entangling their hands and the assailant's weapons. When a plurality of users concurrently employ the device herein in a group of users with similar devices, it makes for a most effective defense against an armed assailant.

In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is therefore an object of the present invention to provide a ballistic or bullet-resistant shield for occupants of a room or other gathering area, which appears as a chair to maintain the style and ambience of the venue in which it is located.

It is another object of this invention to provide such a furniture styled ballistic shield which also provides structural components which may be employed in an offensive act against an attacker while concurrently being shielded from gunshots.

It is a further object of this invention to provide such a chair device which also provides side appendages extending therefrom which afford the user extra protection from ballistic projectiles.

It is yet another object of this invention to provide such a chair, in one or a plurality of different sizes, and with each having gunshot protection, and each of which is lightweight and easily raised by smaller stature users as well as large, during an attack.

It is another object of this invention to provide such a device in the form of a chair or sitting component which is inexpensive to manufacture and therefore widely deployable due to a lower cost.

The foregoing has outlined some of the more pertinent objects of the invention. These objects should be construed to be merely illustrative of some of the more prominent features and applications of the intended ballistic shield invention. Many other beneficial results can be attained by applying the disclosed method and shielding device in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The accompanying drawings, which are incorporated in and form a part of this specification, illustrate embodiments of the invention and together with the detailed description, serve to explain the principles of this invention.

FIG. 9 depicts a perspective view of another preferred mode of the device which provides a "bookshelf" base providing both support and lower projecting members on the base which may be employed for offensive action against an attacker.

FIG. 10 shows the device of FIG. 9 and the support base having a plurality of projecting members and a platform adapted to operatively engage and center the cushion portion.

DETAILED DESCRIPTION OF THE PREFERRED EMBODIMENTS

Figure 1:
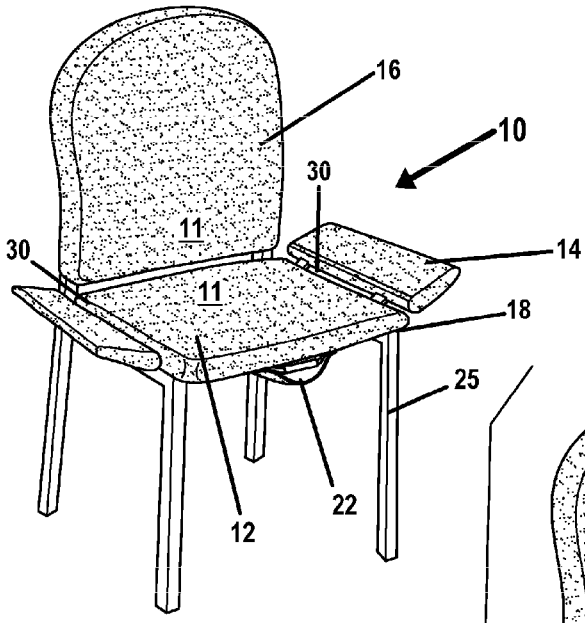
FIG. 1 depicts a perspective view of one preferred mode of the device.

Referring now to the drawings 1-10, wherein similar parts of the invention are identified by like reference numerals, there is seen in FIG. 1, a perspective view of one preferred mode of the device 10 without the additional projecting members 21 of the device in FIG. 9. The device 10 is depicted in a typical fashion as it would be situated in a room or other place of gathering where people sit such as a classroom, meeting room or cafeteria. The device 10, in this mode, has the appearance of a conventional chair and thus maintains the look and the feel of the room as a place where people gather.

Figure 2:
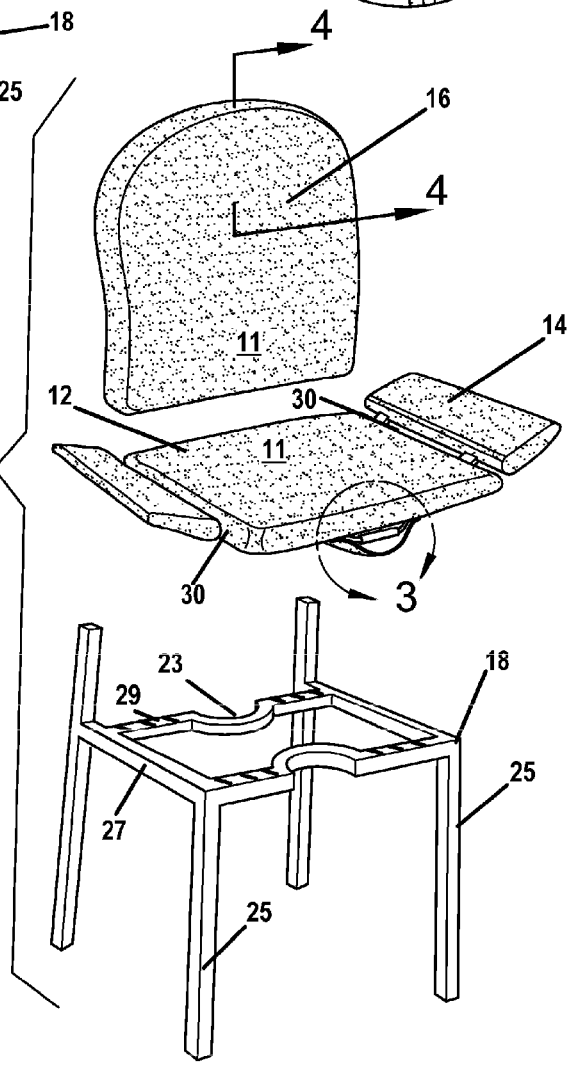
FIG. 2 shows an exploded view of the device of FIG. 1 and the cushion portion elevated above the base having a support platform adapted to engage with the cushion and center it thereon using the projecting handles settling into depressions in the platform.

As FIGS. 1 and 2 show, an exterior surface of upholstery fabric 11 may cover the seat cushion 12, the projecting cushions 14, and the seat back 16. Of course in environments not adapted for the use of upholstery fabric 11 such as outdoor venues, a weather resistant plastic or other water resistant material exterior surface covering may be employed, or any other exterior surface as would occur to those skilled in the art. A base 18 having a plurality of support legs 25 is adapted to engage with and support the seat cushion 12 elevated above a floor or support surface. As noted, the seat cushion 12 may be permanently engaged to the base 18 using fasteners or screws or the like, or may be engaged using hook and loop fabric thereby allowing for removable engagement. If removably engaged, a pair of receiving cavities 23 may be formed into the platform 27 section of the base 18 and receive the curved shields 22 and thereby provide means to center the seat cushion 12 onto the platform 27 of the base 18 where it may be engaged.

Figure 4:
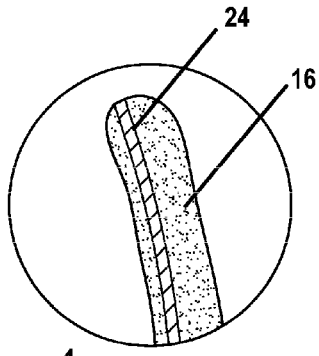
FIG. 4 is a sectional view through the backrest of FIG. 2 and showing at least one ballistic protection layer which is included in the backrest, the seat cushion, and the cushion extensions.
Figure 3:
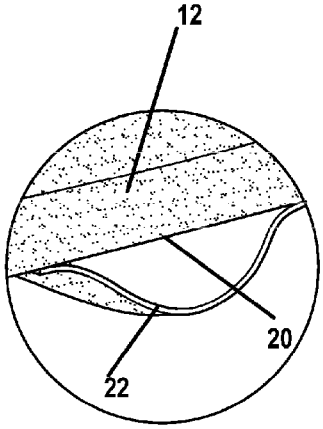
FIG. 3 is an enlarged view of the protective handle component positioned under the front and rear edges of the seat shown in FIG. 2.

As depicted in FIG. 3, a hand grip provided by a handle 20 is shown which is protected by an overlapping shield 22 formed of bullet resistant material such as one or a combination of bullet resistant materials including a plate formed of titanium, ceramic or polyethylene material, or a textile matrix formed of bullet resistant fabric such as aramid. The shield 22 is formed in much the same fashion as the shielding layer 24 depicted in FIG. 4. This shielding layer 24 is formed of a material or materials which are bullet and projectile resistant such as one or a combination of such bullet resistant materials as a plate formed of titanium, ceramic or polyethylene material, or a textile matrix formed of bullet resistant fabric such as aramid. A plurality of such shielding layers 24 may be employed for additional protection. However, at least one shielding layer 24 formed of one or a combination of bullet resistant materials should be included in each of the seat cushion 12, the projecting cushions 14, and the seatback 16. Such a shielding layer 24 or layers should extend substantially to the respective perimeter edges of each of the cushions.

Figure 5:
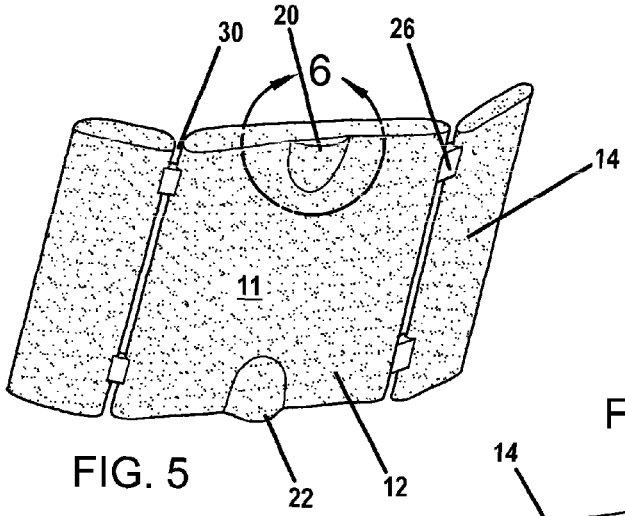
FIG. 5 depicts the seat portion of the device removed from a support base adapted to support it.
Figure 8:
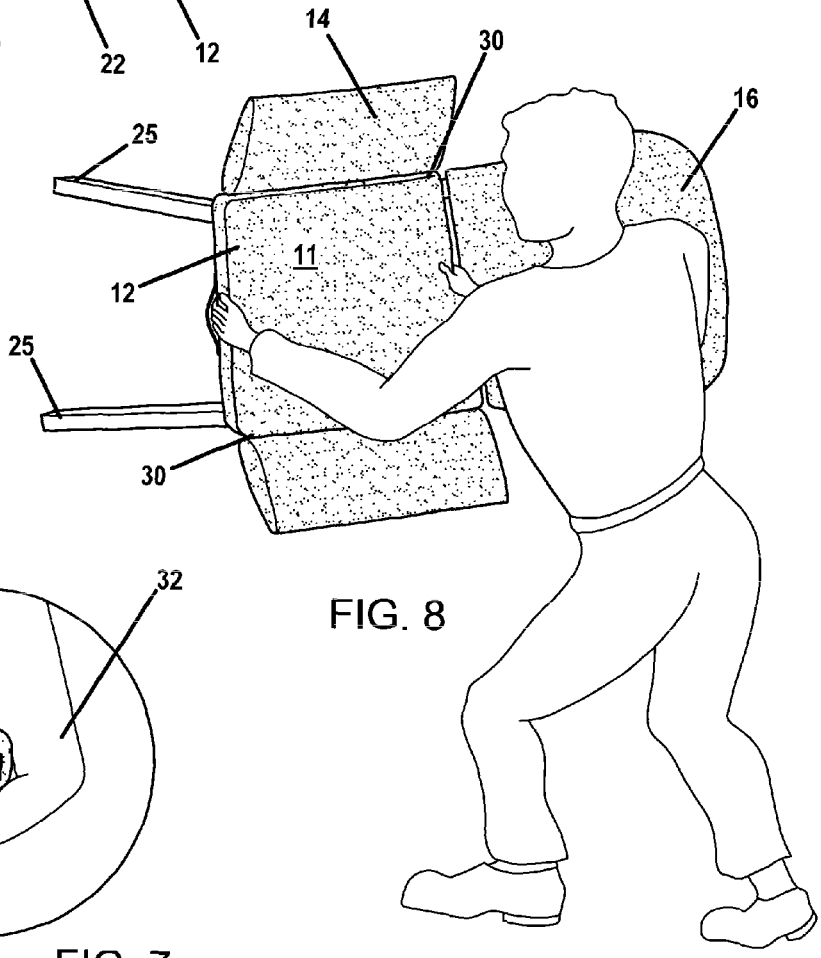
FIG. 8 depicts a user gripping the cushion of the device in an as-used position by employing the provided hand grips with shields.

In FIG. 5 is seen the lower or bottom surface of the seat cushion 12 on the floor-side of the seat cushion 12 showing the shields 22 overlapping and covering the handles 20 and thereby providing means to shield the hands of the user after the user picks up the device 10 and holds the device 10 in an as-used position of FIG. 8 during use. The user's hands are covered by the shields 22 when gripping the handles 20. The curved shape of the shields 22 is preferred as such an arched or curved configuration better resists and ricochets an impacting bullet. Further, in the mode of the device 10 wherein the seat cushion is removable, the curved shape of the shields 22 provides a means to center the cushion onto the engaging platform 27 by sliding them onto the edge of the cavities 23 formed into the engaging platform for the seat cushion 12. However, any shield 22 covering the hands of the user holding the device 10 elevated with their hands, is considered within the scope of this application.

Also shown are the fasteners 26 engaging the cushion extensions 14 to the seat cushion 12 and thereby forming gaps 30 therebetween. These gaps 30 provide the user a means to view the area of the room or venue opposite the side of the seat cushion 12 adjacent to their face in the form of a viewing slit when employing the device in the as-used position of FIG. 8.

While the device 10 will function without the cushion extensions 14 and still provide protection against an armed assailant as well as offensive capability heretofore ignored, the employment of the cushion extensions 14 is preferred in all modes of the device 10 due to their provision of a larger area of protection to the user. The cushion extensions 14 may also be attached directly to the base 18 or to the seatback 16 using extending members and fasteners. However, the engagement of these cushion extensions 14 to the seat cushion 12 provides a superior positioning to allow for the gap 30 to be formed and maintained. The size or width of the gap 30 may be adjusted if the fasteners 26 allow for a rotational or translational engagement of the cushion extensions 14 to the seat cushion 12. If rotatably engaged, the adjustment is accomplished by rotating the cushion extensions 14 to lessen the width of the gap 30 or enlarge it. If translational, the gap size is adjusted by pulling or pushing the cushion extensions 14 away from, or toward, the seat cushion 12. If the fasteners 26 are a means for rotational engagement, they would function much like a hinge. If the fasteners 26 are a means for translational engagement, they would function in a telescopic fashion where pulling away will enlarge the gap 30 and pushing the two cushions toward each other will shrink the size of the gap 30.

Figure 6:
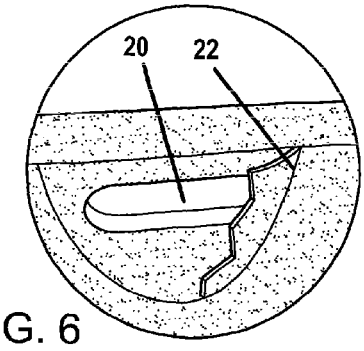
FIG. 6 shows an enlarged cutaway view of the hand grips formed into the seat portion and the overlying protective cover employed to protect the user's hands.
Figure 7:
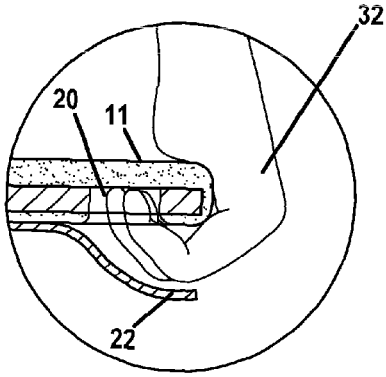
FIG. 7 is a view of the formed hand grip in the cushion gripped by a user in the as-used position of FIG. 8.

FIGS. 6 and 7 depict additional views of the protective hand grip provided by the handle 20 and protective shield 22 and show the user's hands 32 when holding the device 10 in an as-used position. Holding the device 10 using the protected hand grips provided by the handle 20 and shield 22 also positions the gap 30 to provide a viewing slit for the user through the device 10. This viewing slit provides a means for the user to ascertain what or who is on the other side of the device 10 from their protected position. The viewing slit formed by the gap 30 may be narrow in width, such as inch or less, to provide the means for viewing to the user but concurrently protect them against thrown objects, or knives, or even gunshots since the majority of the surfaces of the device 10 afford protection against high speed projectiles such as a bullet and it is unlikely an assailant would aim for the gap 30 during an attack.

As noted above, a particularly preferred mode of the device 10 is shown in FIG. 9 wherein the base 18 provides both support for the device 10 on a floor surface, as well as one or a plurality of projecting members 21 extending from the base 18 in substantially the same direction as the supporting legs 25 of the base 18. The projecting members 21 extending from their attachment to the base 18, for instance to cross members 19, and within a perimeter formed by imaginary lines running between the supporting legs 25 to a distal end, and provide a means for offensive attack against an assailant.

The device 10 is shown in exploded fashion in FIG. 10 and depicts the base 18 having an engaging platform 27 which may be supported by the supporting legs 25, and having cavities 23 for receiving the raised shields 22 covering the handles 20 to allow the seat cushion 12 to remain level with the device 10 when positioned on the floor. The cavities 23 also provide a means for centering the seat cushion 12 on the platform 27 of the base 18 where it may be removably or permanently attached. If permanently attached, the seat cushion 12 would employ conventional screws or other means for a permanent attachment. If removably attached, as an option to allow only the seat cushion 12 to be held aloft, for instance when retreating, and where the base 18 might be ungainly to carry, removable means for attachment 29 can be employed as a means of attachment to platform 27. Of course any removable means for attachment that will render the seat cushion 12 removable as would occur to those skilled in the art is anticipated within the scope of this invention.

Using removable means for attachment 29 such as hook and loop fabric in a plurality of mating points between the platform 27 and the seat cushion 12, which will provide sufficient attachment strength to allow the device 12 to be held in the as-used position, and also allow a user to pull the seat cushion 12 from the engaged platform 27 by holding a supporting leg 25 and pulling on the seat cushion 12, should a retreat become necessary where it's determined by the user that the attached base 18 might make the device 10 too large or ungainly to carry while trying to retreat through doorways or hallways.

While all of the fundamental characteristics and features of the disclosed protective chair device have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

Further, the purpose of the herein disclosed abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed is:

1. A protective chair apparatus comprising:

a base, said base having a supporting platform having a first surface and having an opposing second surface;

a plurality of support legs extending away from said first surface to distal ends which are adapted to contact a support surface;

a seatback cushion engaged to said base, said seatback cushion having at least one bullet resistant layer;

a seat cushion having at least one said bullet resistant layer, said seat cushion having an upper surface and a lower surface;

means of attachment of said lower surface of said seat cushion to said base, in a contact with said second surface of said supporting platform;

a pair of recesses formed in a lower surface of said seat cushion;

each of said recesses defining a hand grip for each hand of a user of said protective chair whereby said chair in a seating position with said distal ends of said legs contacting said support surface, may be picked up by said user and held elevated in an as-used position;

a pair of shields, each of said shields covering one respective of said recesses, each of said shields being bullet resistant; and said shields shielding the hands of said user when said protective chair is picked up from said seating position and held by said user in said as-used position, whereby a user may grip said chair with their hands engaged in said recesses and hold it elevated in said as-used position with both said seatback and said seat cushion providing protection from bullets or high speed projectiles approaching said protective chair in a direction heading from said distal end of said support legs, toward said first side of said base.

2. The protective chair of claim 1, additionally comprising:

a pair of extending cushions;

means for engagement of said extending cushions to said chair in an attached position;

each respective said extending cushions in said attached position having a first side substantially parallel to one of two opposite edge surfaces of said seat cushion;

each said extending cushions extending from said first side to a second side distanced away from said first side of said extending cushion;

each of said extending cushions having at least one said bullet resistant layer;

a gap formed between each of said extending cushions and a respective of said opposite edge surfaces of said seat cushion; and each said gap defining a viewing slit, said viewing slit providing means for said user to view an area extending away from said first surface of said base toward said distal ends of said legs, whereby a user holding said protective chair in said as-used position, may view through said gap to see what or who is on the opposite side of said seat cushion from said user.

3. The protective chair of claim 2, additionally comprising:

said means for engagement of said extending cushions provides a rotatable engagement of said extending cushions allowing for a rotation of each said extending cushion; and a said rotation providing means to adjust a width of said gap from a narrowest point to a widest point, whereby a said user may adjust the size of said gap by rotating one said extending cushion.

4. The protective chair of claim 3, additionally comprising:

one or a plurality of secondary members;

each said secondary member extending from an attachment to said base, in a direction away from said first surface of said base, to a distal end of said secondary member; and said secondary members providing said user a means to attack an assailant, by advancing said base and concurrently said distal end of said secondary members toward said assailant.

5. The protective chair of claim 3, wherein means of attachment of said lower surface of said seat cushion to said base, in a contact with said second surface of said supporting platform, provides means for removable engagement of said seat cushion to said base, whereby said seat cushion may be removed from said base and employed as a shield by said user.

6. The protective chair of claim 5 wherein said means for removable engagement comprises hook and loop fabric.

7. The protective chair of claim 2, additionally comprising:

one or a plurality of secondary members;

each said secondary member extending from an attachment to said base, in a direction away from said first surface of said base, to a distal end of said secondary member; and said secondary members providing said user a means to attack an assailant, by advancing said base and concurrently said distal end of said secondary members toward said assailant.

8. The protective chair of claim 7, wherein means of attachment of said lower surface of said seat cushion to said base, in a contact with said second surface of said supporting platform, provides means for removable engagement of said seat cushion to said base, whereby said seat cushion may be removed from said base and employed as a shield by said user.

9. The protective chair of claim 8 wherein said means for removable engagement comprises hook and loop fabric.

10. The protective chair of claim 2, wherein means of attachment of said lower surface of said seat cushion to said base, in a contact with said second surface of said supporting platform, provides means for removable engagement of said seat cushion to said base, whereby said seat cushion may be removed from said base and employed as a shield by said user.

11. The protective chair of claim 10 wherein said means for removable engagement comprises hook and loop fabric.

12. The protective chair of claim 1, additionally comprising:

one or a plurality of secondary members;

each said secondary member extending from an attachment to said base, in a direction away from said first surface of said base, to a distal end of said secondary member; and said secondary members providing said user a means to attack an assailant, by advancing said base and concurrently said distal end of said secondary members toward said assailant.

13. The protective chair of claim 12, wherein means of attachment of said lower surface of said seat cushion to said base, in a contact with said second surface of said supporting platform, provides means for removable engagement of said seat cushion to said base, whereby said seat cushion may be removed from said base and employed as a shield by said user.

14. The protective chair of claim 13 wherein said means for removable engagement comprises hook and loop fabric.

15. The protective chair of claim 1, wherein means of attachment of said lower surface of said seat cushion to said base, in a contact with said second surface of said supporting platform, provides means for removable engagement of said seat cushion to said base, whereby said seat cushion may be removed from said base and employed as a shield by said user.

16. The protective chair of claim 15 wherein said means for removable engagement comprises hook and loop fabric.

17. The protective chair of claim 1, wherein means of attachment of said lower surface of said seat cushion to said base, in a contact with said second surface of said supporting platform, provides means for removable engagement of said seat cushion to said base, whereby said seat cushion may be removed from said base and employed as a shield by said user.

18. The protective chair of claim 17 wherein said means for removable engagement comprises hook and loop fabric.

19. The protective chair of claim 17 further comprising:

said seatback cushion having a plurality of said bullet resistant layers; and said seat cushion having a plurality of said bullet resistant layers.

20. The protective chair of claim 1 further comprising:

said seatback cushion having a plurality of said bullet resistant layers; and said seat cushion having a plurality of said bullet resistant layers.

* * * * *